US010373534B2

(12) United States Patent
Katz

(10) Patent No.: US 10,373,534 B2
(45) Date of Patent: Aug. 6, 2019

(54) EXIT SIGN WITH MULTI-DIRECTIONAL LIGHTING

(71) Applicant: Best Lighting Products, Inc., Pataskala, OH (US)

(72) Inventor: Jeffrey Scott Katz, Pickerington, OH (US)

(73) Assignee: Best Lighting Products, Inc., Pataskala, OH (US)

( * ) Notice: Subject to any disclaimer, the term of this patent is extended or adjusted under 35 U.S.C. 154(b) by 0 days.

(21) Appl. No.: 15/866,854

(22) Filed: Jan. 10, 2018

(65) Prior Publication Data

US 2019/0213926 A1 Jul. 11, 2019

(51) Int. Cl.
*G09F 13/04* (2006.01)
*G09F 13/42* (2006.01)

(52) U.S. Cl.
CPC ..... *G09F 13/0413* (2013.01); *G09F 13/42* (2013.01); *G09F 2013/0436* (2013.01); *G09F 2013/0459* (2013.01)

(58) Field of Classification Search
CPC ..... G09F 13/0413; G09F 2013/0459; F21V 3/0615; F21V 3/0625
USPC ..... 40/553, 205, 570, 737
See application file for complete search history.

(56) References Cited

U.S. PATENT DOCUMENTS 1,469,946 A * 10/1923 Morrison ..... G08B 7/062 315/93
3,136,083 A * 6/1964 Guth, Jr. ..... G09F 13/04 220/3.94
4,385,586 A 5/1983 Schriever
4,649,376 A 3/1987 Frank
4,754,266 A 6/1988 Shand et al.
4,808,977 A 2/1989 Hedrick
5,446,440 A * 8/1995 Gleason ..... G08B 7/062 340/331
6,025,773 A 2/2000 Bresnan
6,237,266 B1 5/2001 Tassey et al.
6,843,010 B2 1/2005 Robinson et al.
7,581,849 B2 * 9/2009 Mock ..... G09F 9/35 362/234
7,845,103 B2 12/2010 Logan et al.
9,633,584 B2 4/2017 Underwood
2001/0049894 A1 12/2001 Ingraham
2003/0204976 A1 * 11/2003 Doerr, Jr. ..... G09F 19/18 40/553

(Continued)

*Primary Examiner* — Joanne Silbermann

(74) *Attorney, Agent, or Firm* — Diederiks & Whitelaw, PLC.

(57) ABSTRACT

An exit sign includes a main body, a front panel and at least one light source. The main body includes a rear portion, a peripheral side portion and an opening. The peripheral side portion has a first translucent area which is U-shaped. The front panel is received in the opening and includes a symbol indicating a location of a building exit, with the symbol establishing a second translucent area. The at least one light source emits light through the first and second translucent areas, with the first translucent area providing lighting directly in front of the exit sign, directly below the exit sign and directly on either side of the exit sign. The exit sign is particularly configured to be mounted low on a hallway wall to enable a person crawling below a level of smoke in the hallway to be visually guided to an exit door.

22 Claims, 7 Drawing Sheets

(56) References Cited

U.S. PATENT DOCUMENTS

| | | | | |
|---|---|---|---|---|
| 2007/0277411 | A1* | 12/2007 | Logan | G09F 7/18 40/541 |
| 2008/0204258 | A1* | 8/2008 | Dayton | F21V 23/0442 340/600 |
| 2009/0096630 | A1 | 4/2009 | Belanger | |
| 2011/0138665 | A1* | 6/2011 | Liu | F21S 9/022 40/570 |
| 2012/0038479 | A1 | 12/2012 | Ten Wolde | |
| 2017/0193769 | A1 | 7/2017 | McSheffrey | |
| 2018/0096634 | A1* | 4/2018 | Walker | F21V 21/08 |

* cited by examiner

EXIT SIGN WITH MULTI-DIRECTIONAL LIGHTING

BACKGROUND OF THE INVENTION

The present invention pertains to exit signs and, more particularly, to an exit including multi-directional lighting.

Exit signs are generally provided in a building to help direct people inside the building to the nearest exit. This is particularly beneficial in the case of an emergency but can also be useful to a person navigating an unfamiliar building. In either case, it is desired that exit signs be readily noticeable. Specifically, in the event of a fire, a person may find themselves crawling through a building to stay below the level of the smoke caused by the fire. It would be desirable to provide exit signs that can be easily seen in such a situation.

SUMMARY OF THE INVENTION

The present invention provides an exit sign with multi-directional lighting. The exit sign has a slim design, while the lighting increases the visibility of the sign for users located to the side of the sign, thereby aiding in drawing attention to the sign. In particular, the exit sign includes a main body and a front panel. The front panel includes one or more symbols indicating the direction and/or location of a building exit. The front panel is snap-fittingly received in an opening of the main body portion. This feature helps make the exit sign relatively slim. The main body portion further includes a peripheral side portion having a translucent area, defined by a unitary, refractive lens cover, which is U-shaped. A light source is configured to emit light through the translucent area, with the U-shape of the translucent area providing for the projection of light in multiple directions, including an area leading up to the sign, an area in front of the sign and an area beyond the sign. This feature helps make the exit sign more visible for a user located at or to either side of the exit sign, while also further enhancing the user's ability to locate the related exit. This lighting arrangement can be especially beneficial when the exit sign is mounted relatively low on a wall since the floor and the lower portion of the wall will be illuminated, thereby aiding a person crawling along the floor, such as in the case of the person attempting to exit through a smoke filled building hallway, in locating a suitable exit.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

Figure 1:
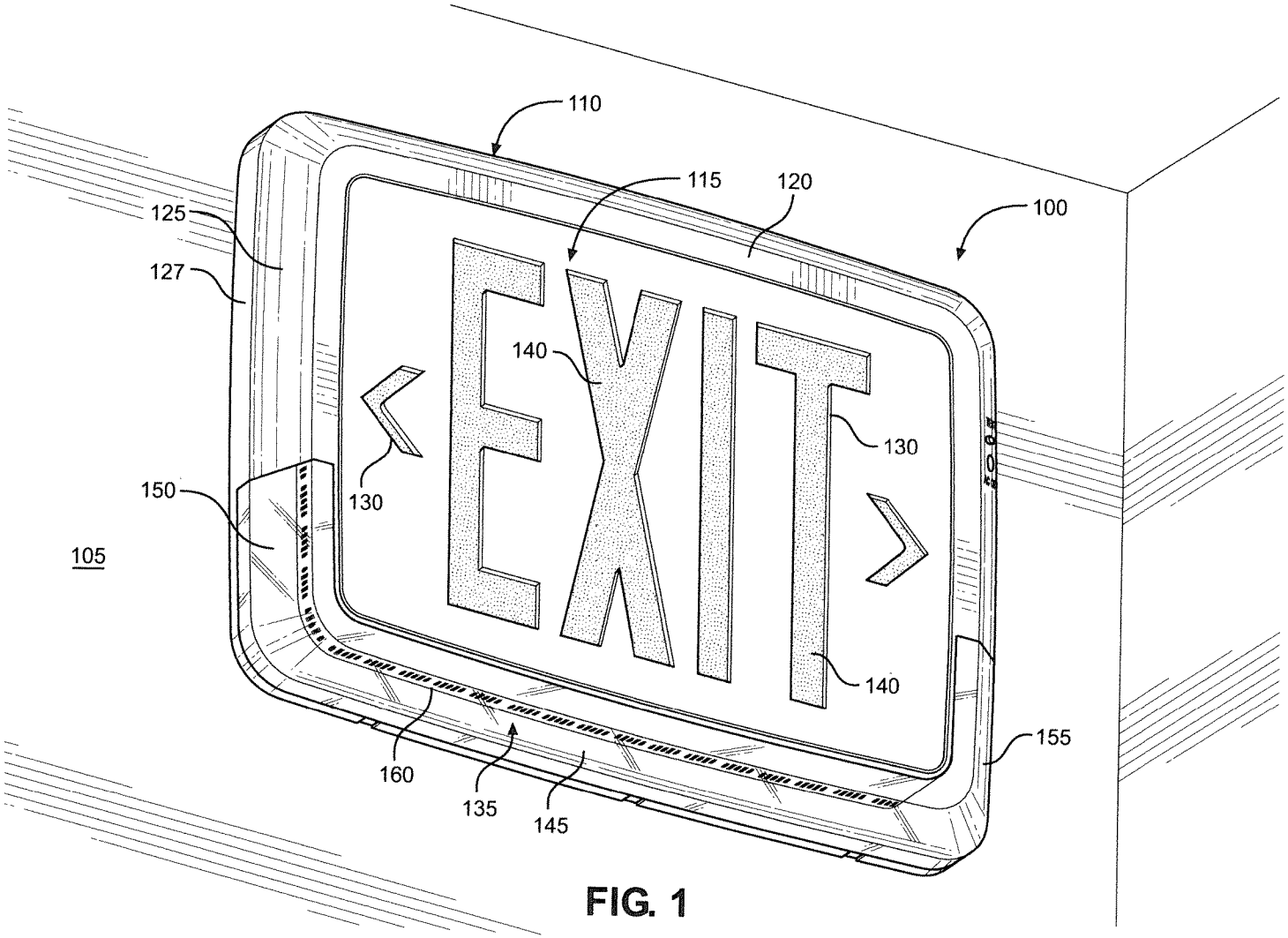
FIG. 1 is a perspective view of an exit sign, constructed in accordance with the present invention, attached to a wall.

With initial reference to FIG. 1, there is shown an exit sign 100 constructed in accordance with the present invention. Exit sign 100 is shown mounted to a wall 105. In some embodiments, exit sign 100 is mounted to wall 105 near the ceiling (i.e., within about 3 feet or one meter of the ceiling). In other embodiments, exit sign 100 is mounted to wall 105 near the floor (i.e., no more than 3 feet or approximately one meter from the floor). Exit sign 100 comprises a main body 110 and a front panel 115. Main body 110 includes a front portion 120, an angled peripheral side portion 125 and an annular side portion 127. Main body 110 also includes a rear portion, which is not visible in FIG. 1, and an opening, which is not visible in FIG. 1 due to front panel 115 being received in the opening. As shown, front panel 115 is flush with front portion 120 and surrounded by both peripheral side portion 125 and annular side portion 127. Front panel 115 includes a symbol 130 indicating a location of a building exit. In the embodiment illustrated, symbol 130 comprises the word "EXIT" and two arrows. At this point, it should be noted that exit sign 100 may only include a single directional arrow or even no directional arrows depending on the positioning of exit sign 100 relative to a related building exit. In addition, it should be understood that the content of symbol 130 can vary depending on locality, for example.

Peripheral side portion 125 has a translucent area 135 defined by a unitary lens cover which is preferably formed of plastic and has refractive qualities, and symbol 130 has a translucent area 140. As shown, translucent area 135 is designed to be U-shaped, i.e., the unitary cover is U-shaped. Specifically, peripheral side portion 125 has a lower side portion 145, a first lateral side portion 150 and a second lateral side portion 155, and translucent area 135 forms at least part of lower side portion 145, first lateral side portion 150 and second lateral side portion 155. In preferred embodiments, translucent area 135 extends up at least 25%, more preferably about 33%, of each of first and second lateral side portions 150 and 155. Exit sign 100 includes at least one light source configured to emit light through translucent areas 135 and 140. In particular, exit sign 100 includes a light source 160 which takes the form of an elongated LED strip configured to project light through translucent area 135. Exit sign 100 also includes a light source configured to light up translucent area 140. This light source (identified and discussed further below) is also preferably constituted by a plurality of LEDs and is located behind front panel 115 so as to not be visible in FIG. 1. While two light sources are provided in the embodiment illustrated, it should be understood that a single light source can be used to light up both translucent areas 135 and 140.

Figure 2:
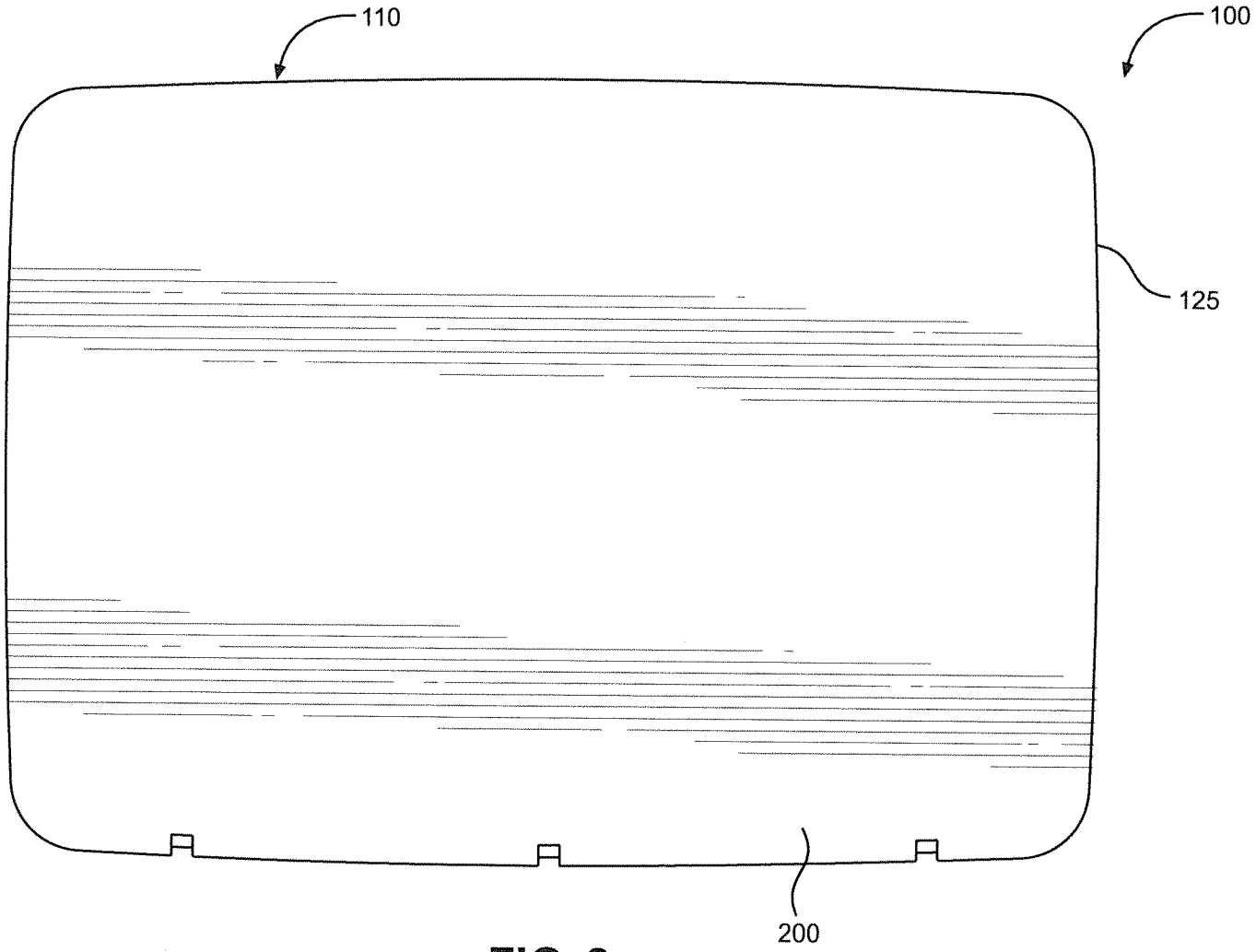
FIG. 2 is a rear view of the exit sign.

FIG. 2 is a rear view of exit sign 100. Accordingly, a rear portion 200 of main body 110 can now be seen. Rear portion 200 is configured to directly contact wall 105 when exit sign 100 is mounted to wall 105. Main body 110 comprises a unitary structure including front portion 120, peripheral side portion 125, annular side portion 127 and rear portion 200. However, in other embodiments, main body 110 can be formed from multiple parts.

Figure 3:
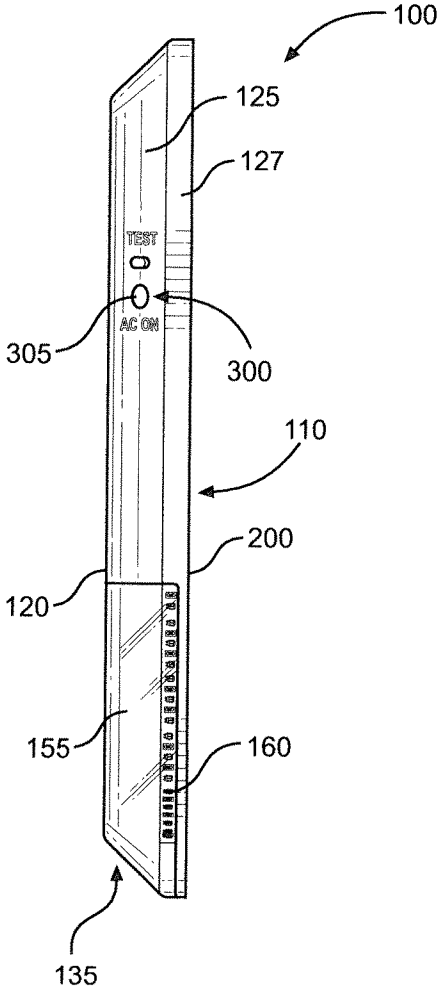
FIG. 3 is a side view of the exit sign.

FIG. 3 is a side view of exit sign 100. This view helps highlight the shape of peripheral side portion 125 and annular side portion 127. In particular, peripheral side portion 125 is not perpendicular to front portion 120 and rear portion 200, while annular side wall portion 127 is generally perpendicular. That is, unlike annular side wall portion 127, peripheral side portion 125 is beveled or, more specifically, chamfered. Translucent area 135 is also beveled or, more specifically, chamfered. The shape of translucent area 135 allows translucent area 135 to be seen from in front of, below and to the sides of exit sign 100. In particular, translucent area 135 is configured to be visible from directly in front of exit sign 100, directly below exit sign 100 and directly to the sides of exit sign 100. In combination with the use of light source 160, this advantageously makes exit sign 100 more readily visible.

FIG. 3 also shows a user interface 300 on peripheral side portion 125. User interface 300 includes a test button (not labeled) and an AC indicator 305, enabling a user to interact with exit sign 100, for example, to test the operability of exit sign 100 for normal and emergency use. Of course, other input or indicator arrangements could be provided as part of user interface 300.

Figure 4:
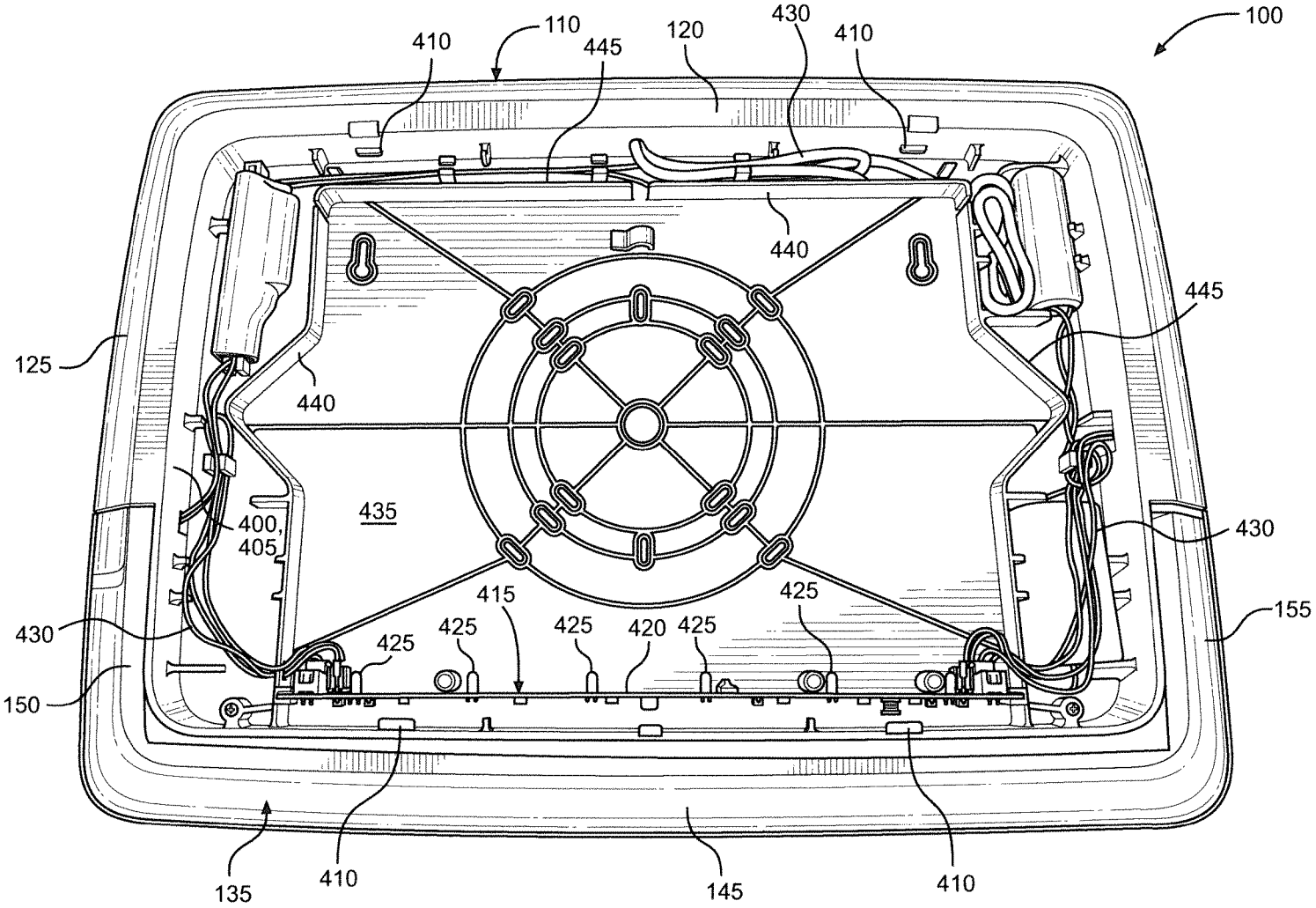
FIG. 4 shows the interior of the exit sign.

In FIG. 4, front panel 115 has been removed so that the interior of exit sign 100 is visible. Also, an opening 400 of main body 110 can now be seen. Opening 400 is formed in front portion 120 of main body 110 and is defined by an interior wall 405 of main body 110. In use, front panel 115 is received in opening 400 such that front panel 115 contacts interior wall 405. Front panel 115 is removably coupled to main body 110 using a snap-fit connection. Specifically, main body 110 includes a plurality of lugs 410 on interior wall 405, which fit into a corresponding plurality of holes in one or more flanges of front panel 115 (not shown in FIG. 4). In addition, a light source 415 is provided within the interior of exit sign 100. Light source 415 is configured to light up translucent area 140 of front panel 115 (not shown in FIG. 4) when front panel 115 is received in opening 400. Light source 415 includes a circuit board 420 and a plurality of light-emitting diodes (LEDs) 425 coupled to circuit board 420. Light source 415 receives power via wiring 430. Wiring 430 also carries power to light source 160 (not visible in FIG. 4), with light source 160 taking the form of a flexible circuit board having a series of generally uniformly spaced LEDs and mounted to interior wall 405 so as to be spaced from the lens cover of translucent area 135.

Main body 110 further includes a base 435 and an upstanding wall 440 extending from base 435 within the interior of exit sign 100. A channel 445 is defined between interior wall 405 and upstanding wall 440. Wiring 430 and other components are located within channel 445, while light source 415 is located within the central area defined by upstanding wall 440. This allows for the unobstructed transmission of light from light source 415 to translucent area 140 of front panel 115. The other components located within channel 445 include a backup battery (not separately labeled) for light source 415 and a separate backup battery (not separately labeled) for light source 160, although a common backup battery could be employed.

Figure 5:
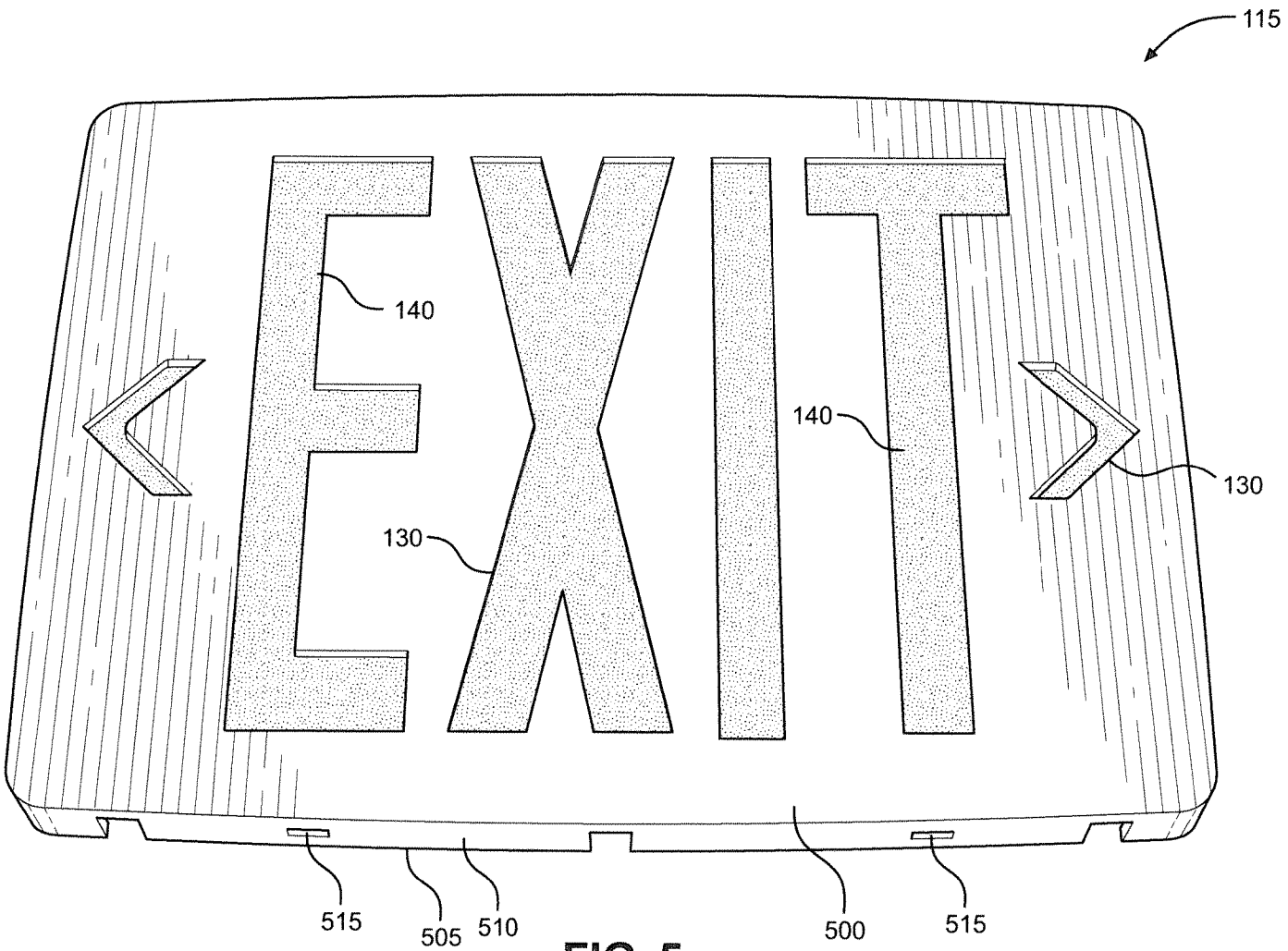
FIG. 5 is a perspective view of a front panel of the exit sign.

FIG. 5 is a perspective view of front panel 115. In addition to the features described above, front panel 115 includes a front portion 500 and a peripheral side or flange portion 505. Peripheral side portion 505 has an outer face 510 that contacts main body 110 when front panel 115 is received in opening 400 (not shown in FIG. 5). Specifically, outer face 510 contacts interior wall 405 of main body 110. Peripheral side portion 505 also has a plurality of holes 515 configured to snap-fittingly receive lugs 410 of main body 110 when front panel 115 is received in opening 400.

The arrangement of front panel 115 within main body 110 allows exit sign 100 to be relatively slim as compared to other exit sign designs. Accordingly, when exit sign 100 is mounted to a wall (e.g., wall 105), exit sign 100 protrudes from the wall to a lesser extent than other exit signs, thereby assuring that exit sign 100 will not obtrusively extend into the path of individuals walking by or otherwise passing exit sign 100.

Figure 6:
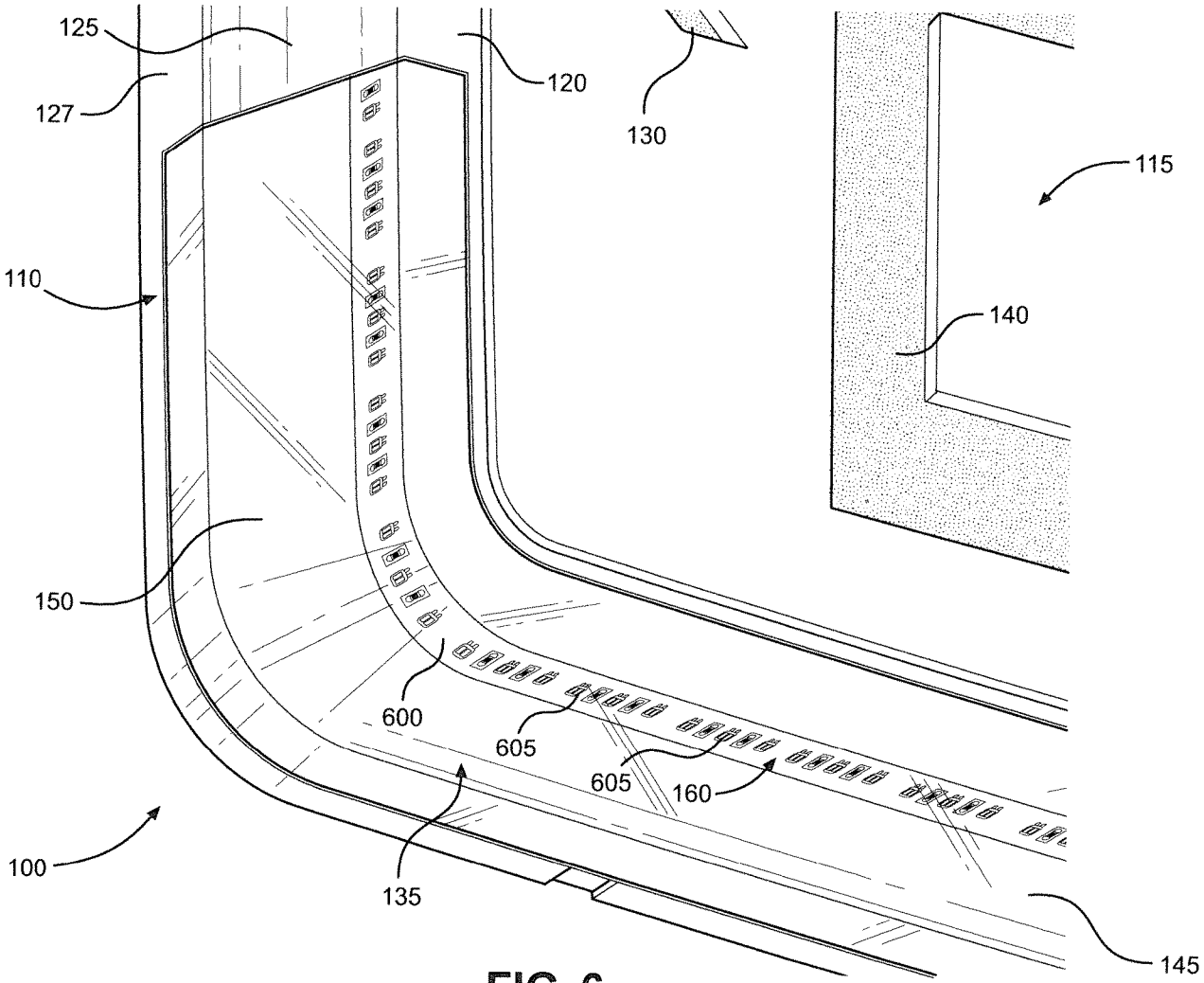
FIG. 6 is an enlarged view of a portion of the exit sign of FIG. 1.

FIG. 6 is an enlarged view of a portion of FIG. 1, particularly showing the lower left corner of exit sign 100. This view helps highlight the construction of light source 160. Light source 160 includes a flexible circuit board 600 and a plurality of generally uniformly spaced LEDs 605 coupled to circuit board 600. As a result, light source 160 essentially comprises a flexible strip of LEDs. This design allows light source 160 to bend around corners and form a "U" shape. Specifically, light source 160 extends from first lateral side portion 150 to second lateral side portion 155 through lower side portion 145.

Figure 7:
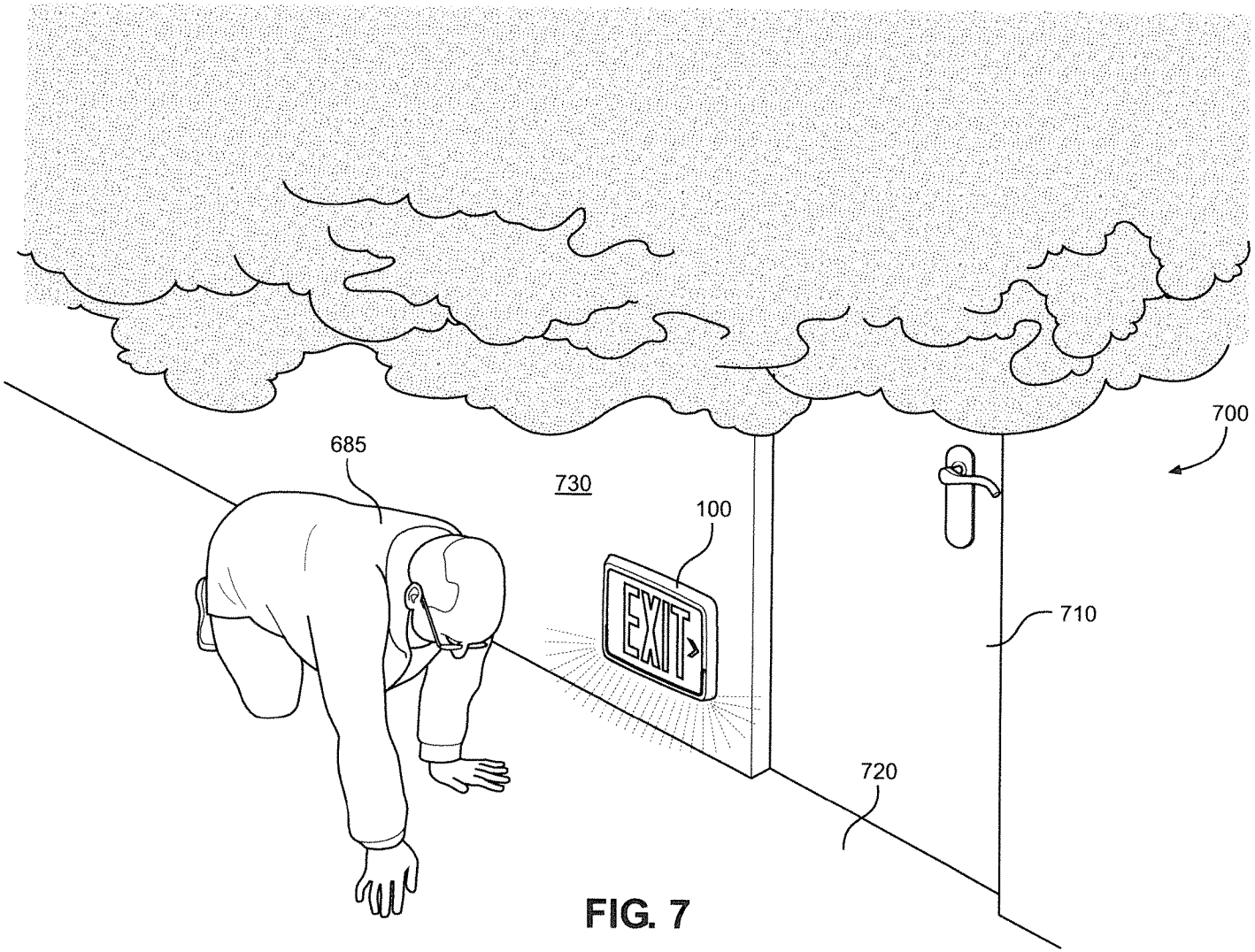
FIG. 7 depicts a person crawling down a hallway while being guided toward an exit door by the exit sign.

Although exit sign 100 could be mounted at a wide range of heights on an interior building wall or even suspended from an interior ceiling, a particularly advantageous use of exit sign 100 is exemplified in FIG. 7 wherein a person 685 is shown crawling through a hallway 700 in search of an exit door 710. Here, exit sign 100 is mounted, above a floor 720, on wall 730. More specifically, exit sign 100 is preferably mounted on wall 730 between 1-3 feet (approximately ⅓-1 meter), preferably no more than 2 feet (approximately ⅔ meter), from floor 720. Basically, if the building is on fire and hallway 700 fills with smoke, the vast majority of the smoke will be in the upper region of hallway 700 as reflected in this figure. In this situation, high wall or ceiling mounted exit signs will not provide the necessary guidance to person 685 and the best course of action would be for person 685 to crawl toward exit door 710. However, with exit sign 100 being mounted in this desired low position along wall 730 (actually a series of exit signs 100 mounted at low positions), person 685 can still be effectively guided to exit door 710. In addition to being able to see the "EXIT" indicia, the U-shaped lighting 160 effectively lights portions of hallway 700 in a uniform continuous light zone extending from before exit sign 100, at exit sign 100 and beyond exit sign 100, i.e., based on the use of the LED lighting strip and the unitary, refractive lens cover, translucent area 135 is visible from directly in front of exit sign 100, directly below exit sign 100 and directly on either side of exit sign 100. As the smoke may even cover the handle of door 710, illuminating beyond exit sign 100 can be instrumental in person 685 efficiently locating and identifying exit door 710.

Based on the above, it should be readily apparent that the present invention provides an exit sign that is readily noticeable and emits a substantially uniform lighting pattern over an enlarged area in the vicinity of the exit sign. The slim design increases the visibility of the sign for users located to the side of the sign, while the lighting helps draw attention to the sign and additional surrounding structure. While certain preferred embodiments of the present invention have been set forth, it should be understood that various changes or modifications could be made without departing from the spirit of the present invention. In general, the invention is only intended to be limited by the scope of the following claims.

The invention claimed is:

1. An exit sign comprising:

a main body including a rear portion and a peripheral side portion, wherein the peripheral side portion has a first translucent area and a non-translucent area, with the first translucent area, as a whole, being U-shaped;

a front panel including a symbol indicating a building exit, wherein the symbol has a second translucent area; and at least one light source configured to emit light through the first and second translucent areas.

2. The exit sign of claim 1, wherein the at least one light source includes a first light source configured to light up the first translucent area and a second light source configured to light up the second translucent area, and the first light source comprises a flexible strip of light-emitting diodes.

3. The exit sign of claim 2, wherein the peripheral side portion has a lower side portion, a first lateral side portion and a second lateral side portion, and the first translucent area forms at least part of the lower side portion, the first lateral side portion and the second lateral side portion.

4. The exit sign of claim 3, wherein the flexible strip is U-shaped.

5. The exit sign of claim 4, wherein the flexible strip extends across the lower side portion and up at least 25% of each of the first and second lateral side portions.

6. The exit sign of claim 3, wherein the main body includes an interior wall spaced from the first translucent area of the peripheral side wall, said flexible strip being mounted directly to the interior wall.

7. The exit sign of claim 1, wherein the peripheral side portion is beveled, and the first translucent area is beveled.

8. The exit sign of claim 1, wherein the front panel includes a front portion and a peripheral flange portion, the peripheral flange portion has an outer face, and the outer face contacts the main body.

9. The exit sign of claim 1, wherein an opening is established by the peripheral side portion and the front panel is snap-fittingly received in the opening.

10. The exit sign of claim 1, wherein the first translucent area is configured to be visible from directly in front of the exit sign, while the second translucent area is configured to be visible from directly in front of the exit sign, directly below the exit sign and directly on either side of the exit sign.

11. The exit sign of claim 10, wherein the at least one light source is configured to emit a substantially uniform and continuous lighting pattern.

12. The exit sign of claim 1, wherein the front panel is flush with the front portion.

13. The exit sign of claim 1, wherein the main body comprises a unitary structure including the front portion, peripheral side portion and rear portion.

14. The exit sign of claim 13, wherein the front panel is surrounded by the peripheral side portion.

15. The exit sign of claim 13, wherein the first translucent area is established by a unitary, U-shaped lens cover attached to the main body.

16. The exit sign of claim 1, wherein the front panel is configured to indicate a direction to or location of the building exit.

17. The exit sign of claim 1, wherein the symbol comprises the word "EXIT".

18. A method of directing a person down a hallway to an exit in a building comprising:

providing an exit sign mounted on a wall of the hallway no more than three feet above a floor of the hallway, with the exit sign including a front panel having illuminated exit indicia configured to indicate a direction to or location of the exit, as well as a peripheral side portion having a non-translucent area and a translucent area configured to illuminate the hallway before, at and after the exit sign, wherein the translucent area, as a whole, is U-shaped.

19. The method of claim 18, wherein the exit sign is mounted no more than two feet above the floor of the hallway.

20. The method of claim 18, wherein the exit sign is configured to visually guide the person while the person is crawling below a level of smoke in the hallway.

21. The method of claim 18, wherein the exit sign is illuminated with a first light source configured to light up the exit indicia and a second light source defined by a flexible strip of light-emitting diodes configured to light up the hallway before, at and after the exit sign.

22. The method of claim 21, wherein the second light source emits light through the translucent area in providing a uniform and continuous lighting pattern from before to after the exit sign.

* * * * *